US009517621B2

(12) United States Patent
Sasaki

(10) Patent No.: US 9,517,621 B2
(45) Date of Patent: Dec. 13, 2016

(54) IMAGE FORMING APPARATUS INCLUDING RECORDING HEAD FOR EJECTING LIQUID DROPLETS

(71) Applicant: Shino Sasaki, Kanagawa (JP)

(72) Inventor: Shino Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/522,323

(22) Filed: Oct. 23, 2014

(65) Prior Publication Data

US 2015/0116400 A1 Apr. 30, 2015

(30) Foreign Application Priority Data

Oct. 29, 2013 (JP) ..... 2013-224155

(51) Int. Cl.
*B41J 2/045* (2006.01)
*B41J 2/14* (2006.01)
*B41J 2/155* (2006.01)

(52) U.S. Cl.
CPC ..... *B41J 2/04596* (2013.01); *B41J 2/04581* (2013.01); *B41J 2/04588* (2013.01); *B41J 2/04593* (2013.01); *B41J 2/14274* (2013.01); *B41J 2/155* (2013.01); *B41J 2202/20* (2013.01)

(58) Field of Classification Search
CPC . B41J 2/04596; B41J 2/04581; B41J 2/04588; B41J 2/14274
USPC ..... 347/9–11
See application file for complete search history.

(56) References Cited

U.S. PATENT DOCUMENTS

| | | | | |
|---|---|---|---|---|
| 6,629,740 | B2 * | 10/2003 | Pulman et al. | 347/10 |
| 7,628,463 | B2 | 12/2009 | Sasaki | |
| 8,662,612 | B2 | 3/2014 | Sasaki | |
| 8,721,053 | B2 | 5/2014 | Yasu et al. | |
| 2007/0070112 | A1 * | 3/2007 | Ootsuka | B41J 2/0451 347/20 |
| 2008/0123117 | A1 | 5/2008 | Kimura et al. | |
| 2011/0084996 | A1 * | 4/2011 | Hirato et al. | 347/10 |
| 2013/0063507 | A1 * | 3/2013 | Sasaki | 347/11 |

FOREIGN PATENT DOCUMENTS

| | | |
|---|---|---|
| JP | 2003-127436 | 5/2003 |
| JP | 2007-261204 | 10/2007 |

(Continued)

*Primary Examiner* — Jason Uhlenhake
(74) *Attorney, Agent, or Firm* — Oblon, McClelland, Maier & Neustadt, L.L.P.

(57) ABSTRACT

An image forming apparatus includes a recording head, a head driving control circuit, and a dummy ejection control circuit. The dummy ejection control circuit controls a first dummy ejection operation to eject droplets to a non-image-forming area per a constant length of a continuous medium and second dummy ejection operation to eject droplets not contributing to image formation to an image forming area. The head driving control circuit applies a first non-ejection pulse to pressure generators corresponding to a non-ejection nozzle of the plurality of nozzles to vibrate a meniscus of liquid in the non-ejection nozzle without ejecting liquid droplets, and applies a second non-ejection pulse, which vibrates the meniscus of liquid greater than the first non-ejection pulse, to pressure generators corresponding to non-ejection nozzles of the plurality of nozzles to vibrate a meniscus of liquid in the non-image-forming area.

10 Claims, 10 Drawing Sheets

(56) References Cited

FOREIGN PATENT DOCUMENTS

| | | |
|---|---|---|
| JP | 2009-034859 | 2/2009 |
| JP | 2013-018252 | 1/2013 |
| JP | 2013-059875 | 4/2013 |

* cited by examiner

| | T1 | T2 | T3 | T4 | T5 | T6 | T7 |
|---|---|---|---|---|---|---|---|
| LARGE DROPLET | ○ | ○ | ○ | ○ | ○ | ○ | ○ |
| MEDIUM DROPLET | – | – | – | ○ | – | ○ | ○ |
| SMALL DROPLET | – | ○ | – | – | – | – | – |
| MICRO VIBRATION | ○ | – | – | – | – | – | – |

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application No. 2013-224155, filed on Oct. 29, 2013, in the Japan Patent Office, the entire contents of which are incorporated herein by reference.

BACKGROUND

1. Field

Embodiments discussed herein relate to an image forming apparatus and, in particular, to an image forming apparatus including a recording head for ejecting liquid droplets.

2. Discussion of the Background

Image forming apparatuses are used as printers, facsimile machines, copiers, plotters, or multi-functional devices having two or more of the foregoing capabilities. As one type of image forming apparatus employing a liquid-ejection recording method, for example, an inkjet recording apparatus that uses a recording head (liquid-droplet ejection head) for ejecting liquid droplets is known.

In such a liquid-ejection-type of image forming apparatus, when liquid is not ejected from nozzles of the recording head for a long time, micro-vibration pulses (non-ejection pulses) may be applied to the head to vibrate the meniscus of liquid in the nozzles, without ejecting liquid droplets from the recording head so as to maintain the condition of the nozzles.

To maintain the condition of the nozzles of the recording head, such an image forming apparatus may also perform, during printing, a dummy ejection operation (also referred to as a flushing operation) in which liquid droplets not contributing to image formation (dummy ejection droplets) are ejected from the nozzles of the recording head.

In addition, such an image forming apparatus may be a line-type image forming apparatus capable of printing images on a continuous recording medium, such as a rolled sheet of paper, a continuous sheet of paper, a continuous-form paper, or a web medium. In such a case, unlike a case where cut sheets are used as the recording media, the dummy ejection operation cannot be performed between conveyed recording media. Hence, the image forming apparatus performs one of a first-type dummy ejection operation (referred to as a line flushing operation) to perform dummy ejection on a non-image-forming area per a constant length of the continuous recording medium, or a second-type dummy ejection operation (referred to as a star flushing operation) to eject a less-visible size of liquid droplets for dummy ejection on an image-forming area of the recording medium.

Moreover, a common driving waveform including a micro-driving signal, which vibrates the meniscus of liquid slightly without ejecting droplets, and an overflow driving signal, in which the ink in a nozzle overflows the circumference of the nozzle, but does not become a droplet, is known. In addition, by applying the overflow driving signal, a foreign particle or ink mist can be drawn into the nozzle.

Note that the dummy ejection operation mentioned above discharges the ink with viscosity increased, is not used for printing, and has a role that maintains the nozzle so that normal ejection can be always performed.

However, in the case of using a continuous recording medium, such as rolled paper, the continuation ejection time may be several hours in many cases, and a nozzle omission (non-ejection) may occur under the influence of minute foreign substances, such as minute ink droplets (ink mist), paper powder, and fibers, which adhered near the nozzle during printing. When a droplet ejection operation is continued with the occurrence of the nozzle omission, a lump of ink mist may become large gradually and may fall on the recording medium.

It is difficult to prevent such deposition of ink mist near the nozzle completely in the usual dummy ejection operation.

In this case, using a common driving waveform containing the overflow driving signal, the overflow driving signal may be applied during printing (image formation). However, in this case, the length of the common driving waveform becomes long, driving frequency is lowered, and the print speed on a continuous recording medium is decreased.

SUMMARY

In one aspect of the present disclosure, there is provided an image forming apparatus including a recording head, a head driving control circuit, and a dummy ejection control circuit. The recording head includes a plurality of nozzles, a plurality of individual liquid chambers, and a plurality of pressure generators. Each of the plurality of nozzles ejects liquid droplets. The plurality of individual liquid chambers communicate with the plurality of nozzles. The plurality of pressure generators generates pressure to pressurize liquid in the plurality of individual liquid chambers. The head driving control circuit applies an ejection pulse to a pressure generator of the plurality of pressure generators corresponding to an ejection nozzle of the plurality of nozzles to eject liquid droplets. The dummy ejection control circuit controls a dummy ejection operation to eject liquid droplets not contributing to image formation. The dummy ejection circuit controls a first dummy ejection operation to eject the liquid droplets to a non-image-forming area per a constant length of a continuous recording medium and a second dummy ejection operation to eject the liquid droplets to an image-forming area of the continuous recording medium. The head driving control circuit applies a first non-ejection pulse to pressure generators corresponding to at least one of non-ejection nozzles to vibrate a meniscus of liquid in the non-ejection nozzles without ejecting liquid droplets in the image forming area, and applies a second non-ejection pulse, which vibrates the meniscus of liquid greater than the first non-ejection pulse, to pressure generators corresponding to at least one of the non-ejection nozzles to vibrate the meniscus of liquid in the non-ejection nozzles without ejecting liquid droplets in the non-image-forming area.

BRIEF DESCRIPTION OF THE DRAWINGS

A more complete appreciation of the present inventions and the advantages thereof will be understood by reference to the following detailed description, when considered in connection with the accompanying drawings, wherein.

DETAILED DESCRIPTION

Figure 1:
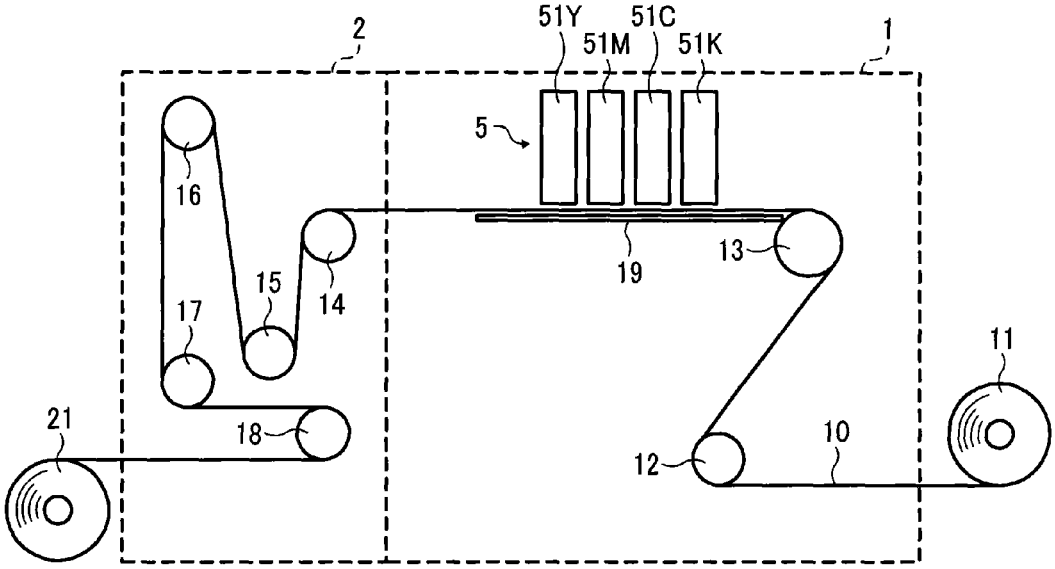
FIG. 1 is a schematic view of an image forming apparatus according to one embodiment of the present disclosure.

In describing the embodiments illustrated in the drawings, specific terminology is adopted for the purpose of clarity. However, the disclosure of the present inventions is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present disclosure will be described.

First, an image forming apparatus according to an embodiment of the present disclosure is described with reference to FIG. 1. FIG. 1 is a schematic view of the image forming apparatus.

The image forming apparatus illustrated in FIG. 1 is a full-line-type inkjet recording apparatus. In the image forming apparatus, an apparatus body 1 and an exit apparatus 2 to secure a drying time are arranged side by side.

In the image forming apparatus, a recording medium 10 is rotationally fed from a media roller 11, fed by feed rollers 12 to 18, and reeled by a reel roller 21.

The recording medium 10 is fed on a platen 19 between the feed roller 13 and the feed roller 14 while opposing an image forming section 5, wherein the image forming section 5 ejects liquid droplets to form an image on the recording medium 10.

The image forming section 5 includes full-line-type recording heads 51K, 51C, 51M, and 51Y (hereinafter, "recording heads 51" unless colors thereof are distinguished) to eject droplets of ink of black (K), cyan (C), magenta (M), and yellow (Y), respectively, onto the recording medium 10 fed from an upstream side in a direction in which the recording medium 10 is fed, i.e., a media feed direction indicated by an arrow D in FIGS. 2 and 3. It is to be noted that the number and types of colors are not limited to the above-described four colors of K, C, M, and Y, and may be any other suitable number and types.

Figure 2:
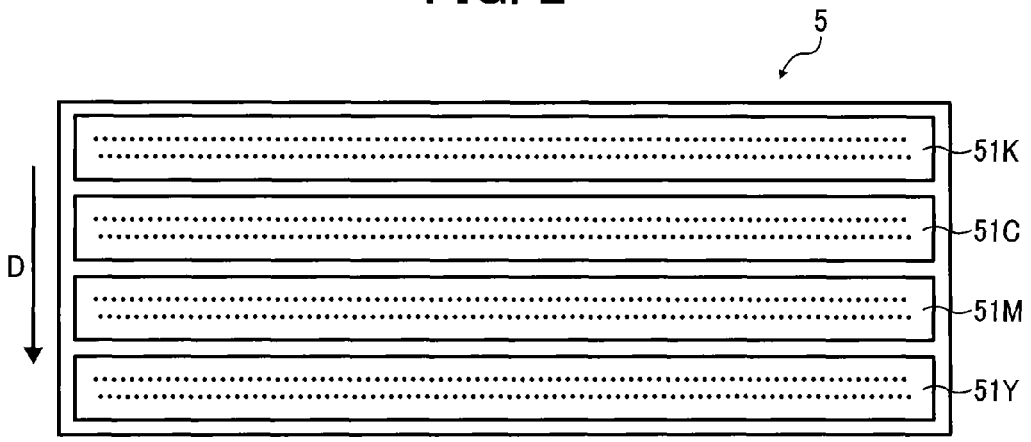
FIG. 2 is a plan view of an example of recording heads of the image forming apparatus according to one embodiment of the present disclosure.

For example, as illustrated in FIG. 2, each of the recording heads 51 may be a full-line-type recording head. Alternatively, as illustrated in FIG. 3, in each of the recording heads 51, short heads 100 may be arrayed as a head array in a zigzag manner on a base member 52 to form a full-line-type recording head having a width corresponding to a width of the recording media. In the present embodiment, the recording head 51 is formed of a liquid ejection head apparatus including a liquid ejection head and a head tank to supply liquid to the liquid ejection head. However, it is to be noted that the configuration of the recording head is not limited to the liquid ejection head apparatus and may be formed of, e.g., only the liquid ejection head.

Figure 4:
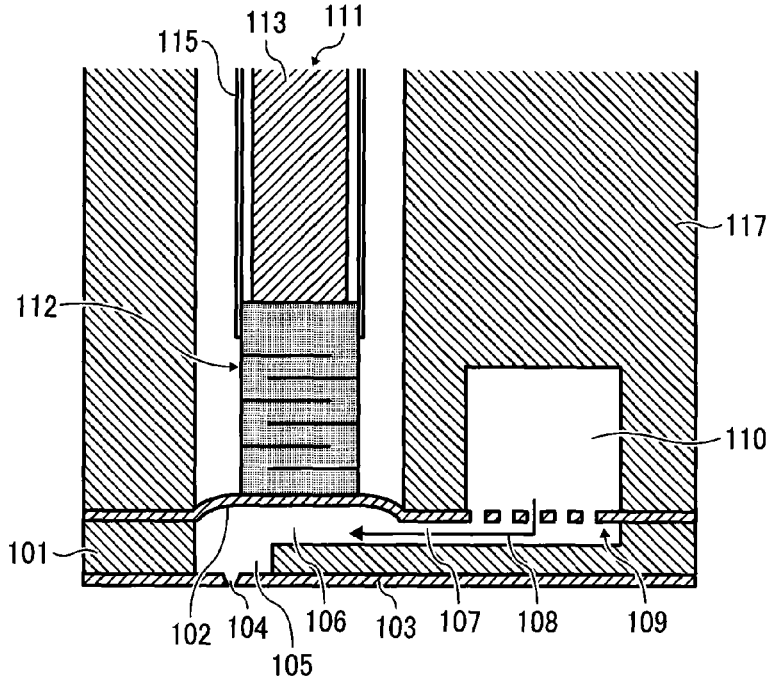
FIG. 4 is a cross-sectional view of a liquid ejection head forming a recording head of the image forming apparatus cut along a longitudinal direction of a liquid chamber according to one embodiment of the present disclosure.
Figure 5:
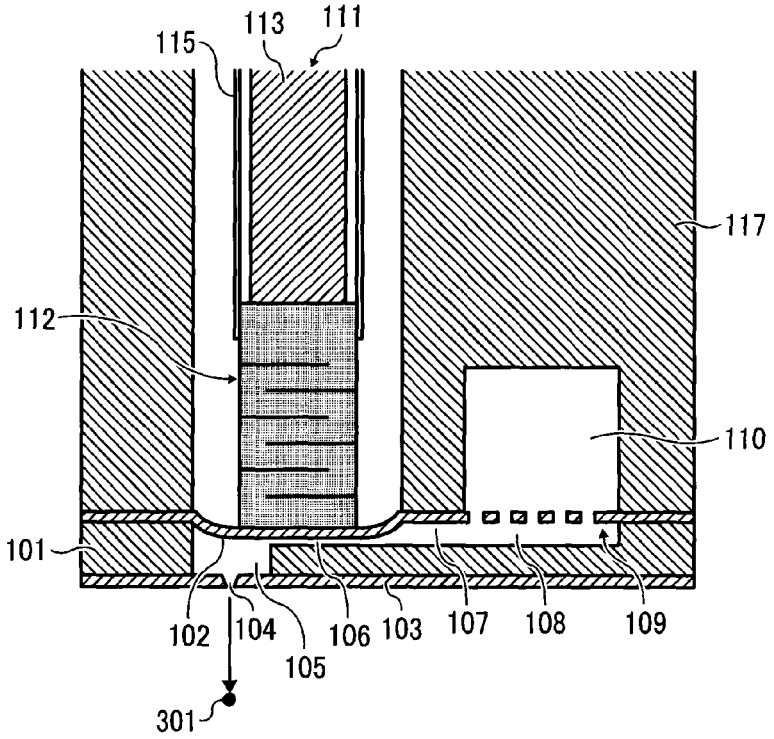
FIG. 5 is a cross-sectional view of the liquid ejection head in a droplet ejection operation according to one embodiment of the present disclosure.

Next, an example of the liquid ejection head forming the recording head is described with reference to FIGS. 4 and 5. FIGS. 4 and 5 are cross-sectional views of the liquid ejection head cut along a longitudinal direction of a liquid chamber of the liquid ejection head (a direction perpendicular to a nozzle array direction). Here, the liquid ejection head having the configuration of FIG. 3 is described with reference to FIGS. 4 and 5.

In the liquid ejection head, a channel plate 101, a diaphragm member 102, and a nozzle plate 103 are bonded together to form individual liquid chambers 106, fluid resistance portions 107, and liquid introducing portions 108. The individual liquid chambers 106 are also referred to as, e.g., pressurization chambers, pressurized liquid chambers, pressure chambers, individual channels, and pressure generating chambers, and hereinafter are simply referred to as "liquid chambers". As illustrated in FIGS. 4 and 5, a liquid chamber 106 communicates via a through hole 105 with a nozzle 104 from which liquid is ejected. A fluid resistance portion 107 and a liquid introducing portion 108 supply liquid to the liquid chamber 106. A common chamber 110 is formed in a frame member 117, and a filter 109 is formed in the diaphragm member 102. The liquid (ink) is introduced from the common chamber 110 to the liquid introducing portion 108 via the filter 109, and is supplied from the liquid introducing portion 108 to the liquid chamber 106 via the fluid resistance portion 107.

The channel plate 101 is formed by laminating metal plates made of, e.g., stainless used steel (SUS) so as to have openings and channels, such as the through holes 105, the liquid chambers 106, the fluid resistance portions 107, and the liquid introducing portions 108. The diaphragm member 102 is a wall member forming a wall face of each of the liquid chambers 106, the fluid resistance portions 107, and the liquid introducing portions 108. In addition, as described above, the filter 109 is formed in the diaphragm member 102. It is to be noted that, instead of laminating metal plates of, e.g., SUS, the channel plate 101 may be formed by, for example, anisotropically etching a silicon substrate.

Figure 3:
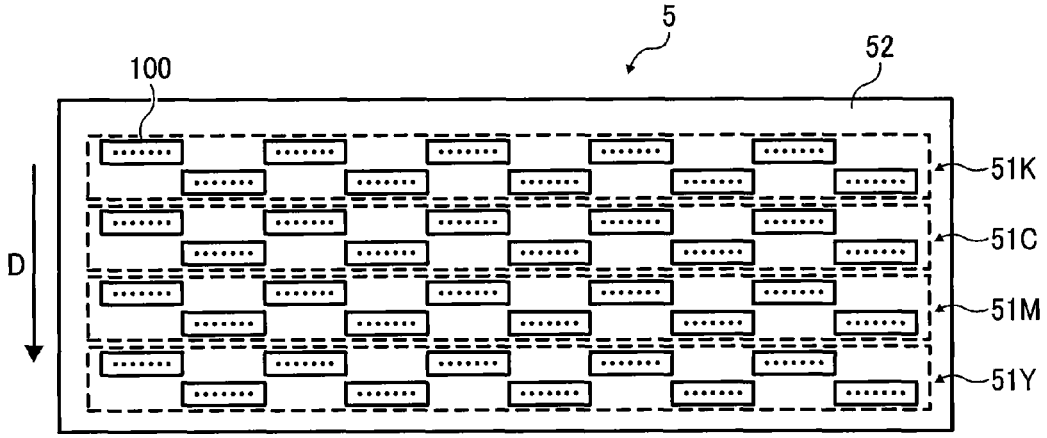
FIG. 3 is a plan view of another example of recording heads of the image forming apparatus according to one embodiment of the present disclosure.

In FIG. 3, a laminated piezoelectric member 112 is bonded to a face of the diaphragm member 102 opposite a face facing the liquid chamber 106. The laminated piezoelectric member 112 is a pillar-shaped electromechanical transducer serving as a driving element (actuator device, pressure generator) to generate energy for applying pressure to ink in the liquid chamber 106 to eject liquid droplets from the nozzle 104. One end of the piezoelectric member 112 is bonded to the base member 113, and flexible printed cables (FPCs) 115 are connected to the piezoelectric member 112 to transmit a driving waveform. Thus, a piezoelectric actuator 111 is formed.

In the present embodiment, the piezoelectric member 112 is used in, for example, a d33 mode to expand and contract in a direction (laminated direction) in which the metal plates are laminated. Alternatively, the piezoelectric member 112 may be used in, for example, a d31 mode to expand and contract in a direction perpendicular to the laminated direction.

In the liquid ejection head having the above-described configuration, for example, as illustrated in FIG. 4, by reducing the voltage applied to the piezoelectric member 113 below a reference potential, the piezoelectric member 112 contracts to deform the diaphragm member 102. As a result, the volume of the liquid chamber 106 expands, thus causing ink to flow into the liquid chamber 106. Then, as illustrated in FIG. 5, by increasing the voltage applied to the piezoelectric member 112 above the reference potential Ve, the piezoelectric member 112 extends in the laminated direction to deform the diaphragm member 102 toward the nozzle 104, thus contracting the volume of the liquid chamber 106. As a result, ink in the liquid chamber 106 is pressurized, thus ejecting a liquid droplet 301 from the nozzle 104.

Then, by returning the voltage applied to the piezoelectric member 112 to the reference potential Ve, the diaphragm member 102 returns to its original position (restores its original shape). As a result, the liquid chamber 106 expands and a negative pressure occurs in the liquid chamber 106, thus replenishing ink from the common chamber 110 to the liquid chamber 106. After vibration of a meniscus surface of the nozzle 104 decays to a stable state, the process shifts to an operation for the next droplet ejection.

Figure 6:
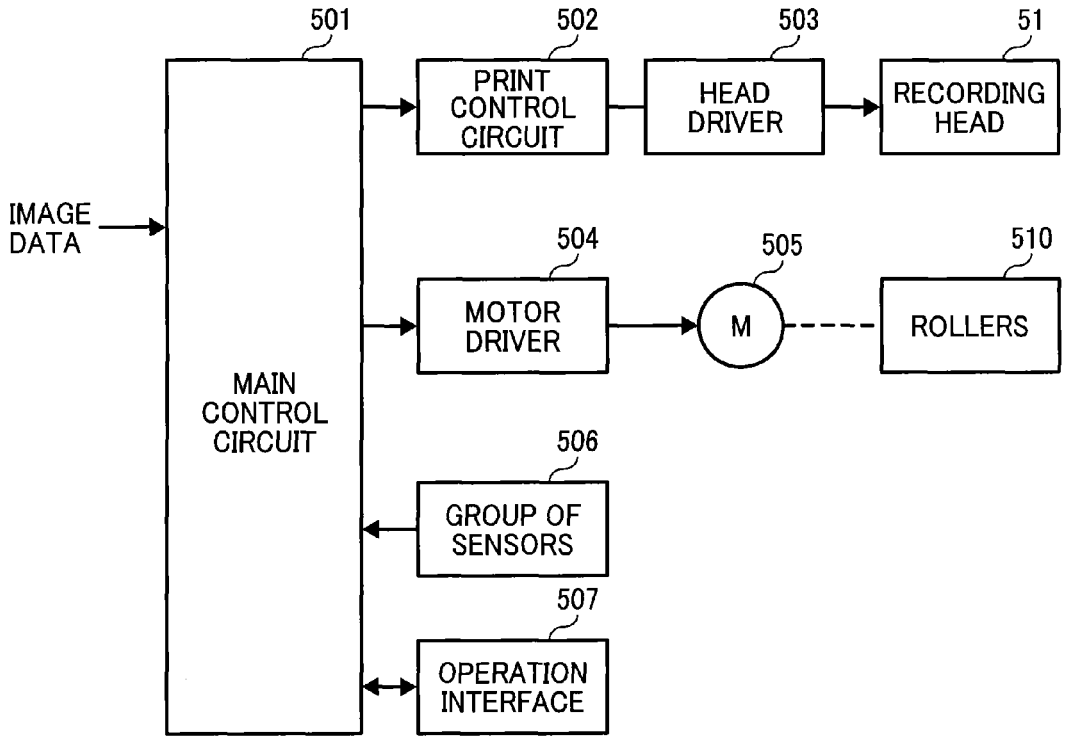
FIG. 6 is a block diagram of a controller of the image forming apparatus according to one embodiment of the present disclosure.

Next, a controller of the image forming apparatus is described with reference to FIG. 6. FIG. 6 is a block diagram of a controller 500 of the image forming apparatus.

The controller has a main control circuit (system controller) 501 including, e.g., a micro-computer (CPU), an image memory, and a communication interface. The main control circuit 501 generally controls the entire image forming apparatus and also serves as a head driving controller and a dummy ejection controller. The main control circuit 501 transmits print data to a print control circuit 502 to form an image on a sheet of recording media in accordance with image data and command information transferred from, e.g., an external information processing device (host).

The print control circuit 502 transfers, as serial data, the image data received from the main control circuit 501 and outputs, to a head driver 503, for example, transfer clock signals, latch signals, and control signals required for the transfer of image data and determination of the transfer. In addition, the print control circuit 502 has a driving waveform generator (701 in FIG. 7) including, e.g., a digital/analog (D/A) converter, a voltage amplifier, and a current amplifier, and outputs a driving signal containing one or more driving pulses to the head driver 503. The D/A converter converts pattern data of driving pulses stored on, e.g., a read-only memory (ROM) from digital data to analog data.

In accordance with serially-inputted image data corresponding to one line recorded by the recording heads 51, the head driver 503 serving as a selective applicator selects driving pulses of a driving waveform transmitted from the print control circuit 502 and applies the selected driving pulses to the piezoelectric member 112 to drive the recording heads 51. Thus, the piezoelectric member 112 serving as the pressure generator generates energy to eject liquid droplets from the recording heads 51. At this time, by selecting a part or all of the driving pulses forming the driving waveform or a part or all of waveform elements forming a driving pulse, the recording heads 51 can selectively eject dots of different sizes, e.g., large droplets, medium droplets, and small droplets.

The main control circuit 501 controls driving of a group of rollers 510 with a motor 505, the group of rollers including, e.g., the media roller 11, the feed rollers 12 to 18, and the reel roller 21 via a motor driver 504.

Detection signals from a group of sensors 506 including various types of sensors are input to the main control circuit 501. The main control circuit 501 inputs and outputs various types of information and transmits and receives display information to and from an operation interface 507.

Figure 7:
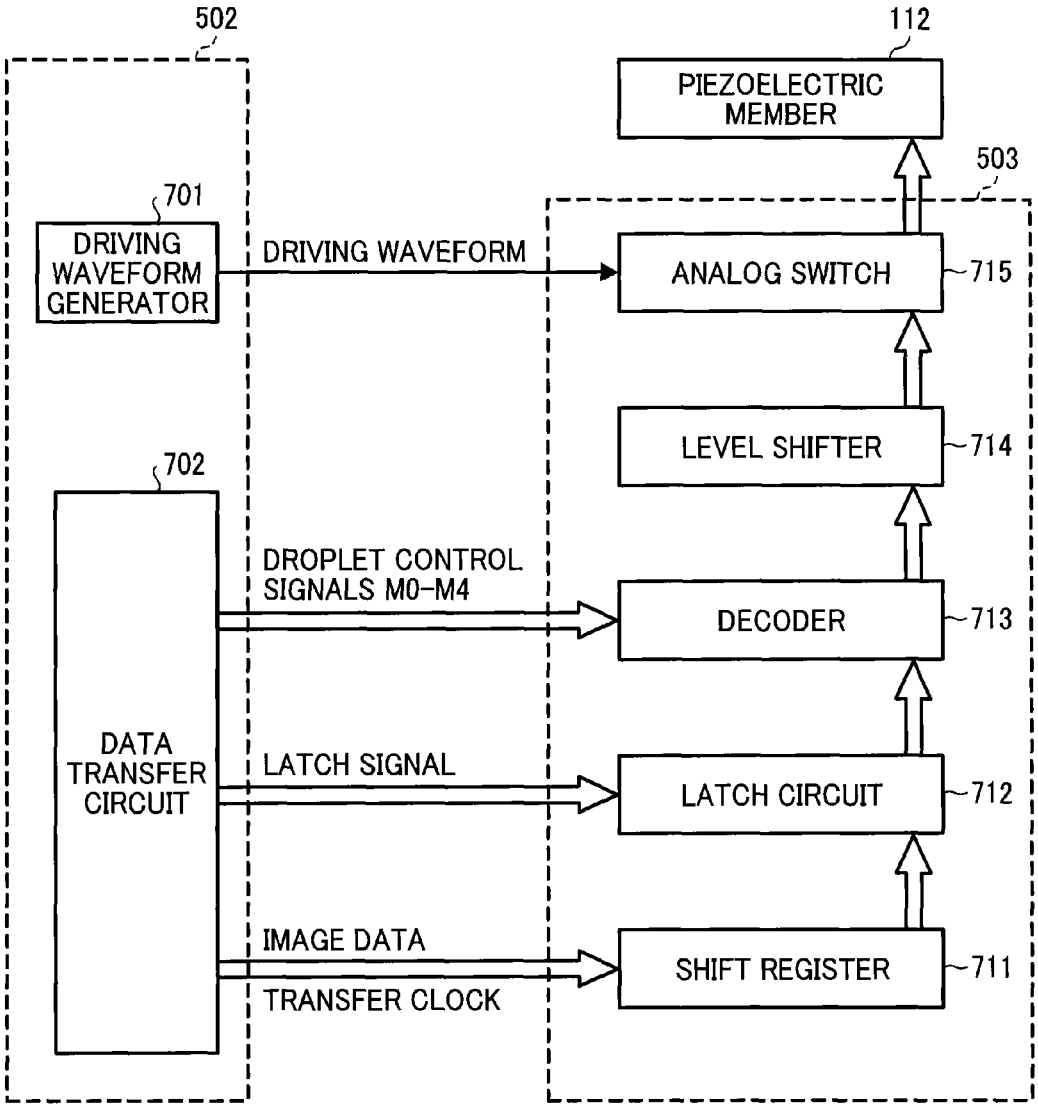
FIG. 7 is a block diagram of a print control circuit of the controller and a head driver according to one embodiment of the present disclosure.

Next, an example of the print control circuit 502 and the head driver 503 is described with reference to FIG. 7.

The print control circuit 502 includes the driving waveform generator 701 and a data transfer circuit 702. The data transfer circuit 702 outputs clock signals, latch signals (LAT), droplet control signals M0 to M4, and two-bit image data (gray-scale signals 0 and 1) corresponding to a print image.

Here, the driving waveform generator 701 generates and outputs a common driving waveform Vcom containing a plurality of pulses (driving signals) within a single print cycle (driving cycle), and a second non-ejection pulse (overflow driving signal) Vo.

In addition, the driving waveform generator 701 can generate and output exclusive driving signals (ejection pulses that make dummy ejection droplets eject) to be used for a line flashing operation (the first dummy ejection operation) and a star flushing operation (the second dummy ejection operation) described below.

The droplet control signals are two-bit signals for instructing the opening and closing of an analog switch 715 serving as a switching device of the head driver 503 in connection with each droplet. In synchronization with the print cycle of the common driving waveform Vcom, the droplet control signals change the state to a high (H) level (ON state) at a selected pulse or waveform element and to a low (L) level (OFF state) at a non-selected pulse or waveform element.

The head driver 503 includes a shift register 711, a latch circuit 712, a decoder 713, a level shifter 714, and the analog switch 715. The shift register 711 receives transfer clocks (shift clocks) and serial image data (gray-scale data: two bits/one channel, i.e., one nozzle) from the data transfer section 702. The latch circuit 712 latches values of the shift register 711 based on latch signals. The decoder 713 decodes gray-scale data and control signals M0 to M4 and outputs decoded results. The level shifter 714 shifts the level of logic-level voltage signals of the decoder 713 to a level at which the analog switch 715 is operable. The analog switch 715 is turned on/off (opened and closed) in response to the outputs of the decoder 713 transmitted via the level shifter 714.

The analog switch 715 is connected to a selection electrode (individual electrode) of each piezoelectric member 112 and receives a driving waveform from the driving waveform generator 701. When the analog switch 715 is turned on in response to a result obtained by decoding the serially-transferred image data (gray-scale data) and the droplet control signals M0 to M4 with the decoder 713, a desired pulse (or waveform element) of the common driving waveform Vcom passes (is selected by) the analog switch 715 and is applied to the piezoelectric member 112.

Next, an example of the dummy ejection operation is described below.

When the image forming apparatus uses a continuous sheet as the recording medium, dummy ejection is performed during printing. Hence, as described above, the dummy ejection controller (which, e.g., is a processor executing programs) controls a dummy ejection operation of the main control circuit 501. In a dummy ejection operation to eject droplets (dummy ejection droplets) not contributing image formation from the recording heads 51, the dummy ejection controller controls, for example, a first dummy ejection operation (e.g., a line flushing operation) to eject droplets for dummy ejection once per constant length of a continuous recording medium and a second dummy ejection operation (e.g., a star flushing operation) to eject a less-visible size of fine droplets for dummy ejection on an image forming area of a continuous recording medium.

Figure 8A:
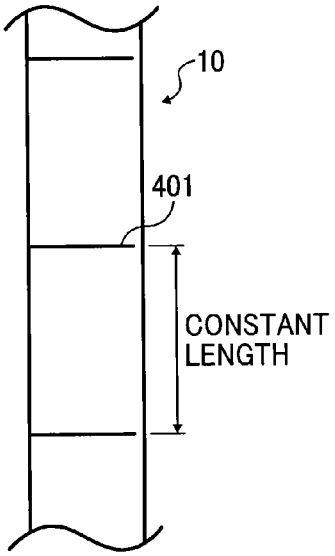
FIG. 8A is a schematic view of an example of line flushing operation (first dummy ejection) according to one embodiment of the present disclosure.

FIG. 8A shows an example of the line flushing operation (first dummy ejection operation). The first dummy ejection is referred to as line flushing since relatively large dummy ejection droplets 401 are deposited on a recording medium so as to form a line.

Figure 8B:
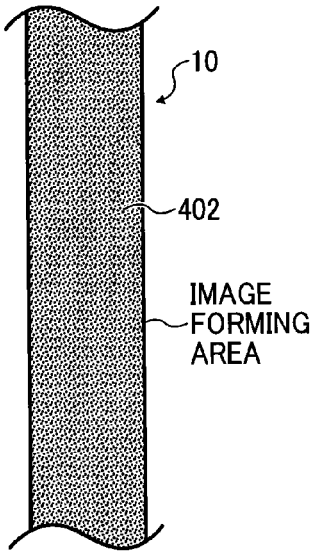
FIG. 8B is a schematic view of an example of star flushing operation (second dummy ejection) according to one embodiment of the present disclosure.

FIG. 8B shows an example of the star flushing operation (second dummy ejection operation). The second dummy ejection is referred to as star flushing since relatively small dummy ejection droplets 402 are scattered like stars on an image forming area of a continuous recording medium.

During printing, ejection pulses for ejecting liquid droplets are applied to pressure generators of ejection nozzles of the recording heads 51, and a first non-ejection pulse (micro-vibration pulse) for vibrating liquid meniscus in the nozzle without ejecting liquid droplets is applied to pressure generators of non-ejection nozzles of the recording heads 51.

Figure 9:
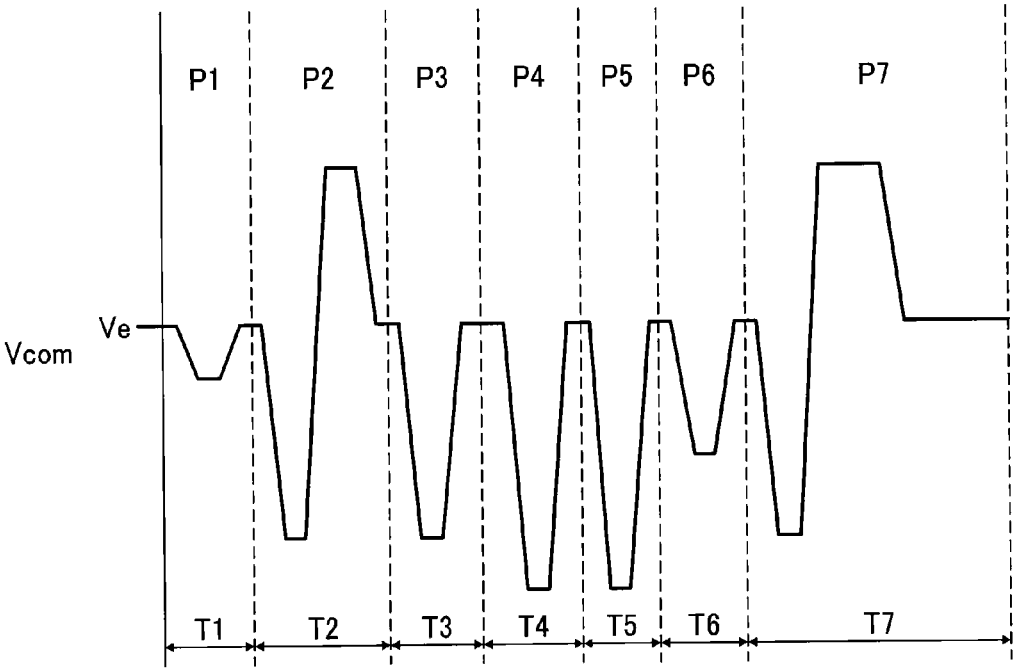
FIG. 9 is a diagram of a driving waveform according to one embodiment of the present disclosure.
Figures 10, 11:
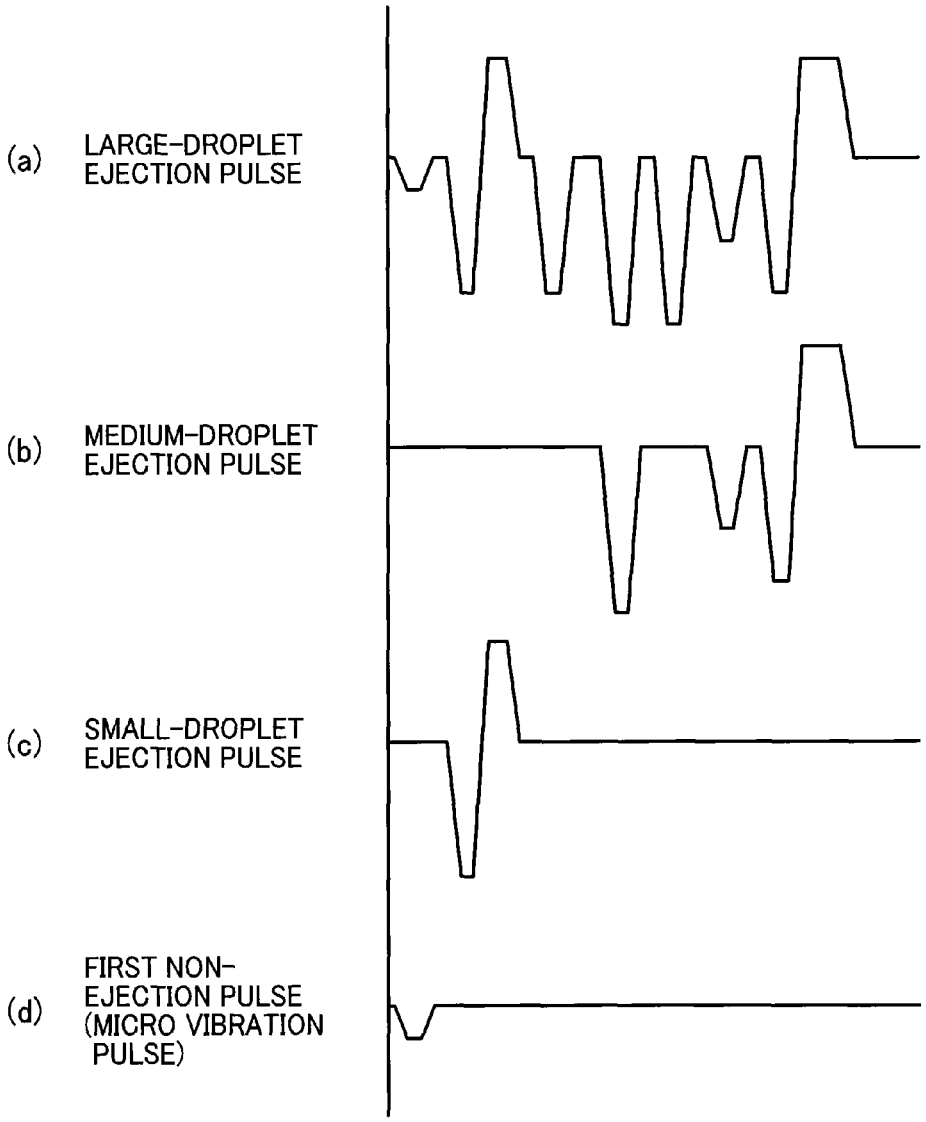
FIG. 10 is a table of selection periods of driving pulses of the driving waveform according to one embodiment of the present disclosure.
FIG. 11 is a chart of ejection pulses and non-ejection pulses generated by selecting one or more of the driving pulses of the driving waveform according to one embodiment of the present disclosure.

Next, an exemplary embodiment of the present disclosure is described with reference to FIGS. 9 to 11. FIG. 9 shows a driving waveform in an exemplary embodiment. FIG. 10 is a table of selection periods of driving pulses of the driving waveform (in the table, circles represent time periods in which the respective driving pulses are selected). FIG. 11 shows ejection pulses and a micro-vibration pulse generated by selecting one or more of the driving pulses of the driving waveform.

The term "driving pulse" used herein represents, e.g., a pulse serving as an element of a driving waveform. The term "ejection pulse" used herein represents, e.g., a pulse applied to a pressure generator to eject a liquid droplet. The term "micro-vibration pulse" used herein represents, e.g., a pulse applied to a pressure generator to vibrate (flow) ink in a nozzle without ejecting a liquid droplet.

As illustrated in FIG. 9, a common driving waveform Vcom includes driving pulses P1 to P7, which are time-serially generated over time periods T1-T7 and outputted.

As illustrated in FIG. 10, when a large droplet is ejected using droplet control signals M0 to M4, all of the driving pulses P1 to P7 are selected to generate an ejection pulse for a large droplets (large-droplet ejection pulse) illustrated in FIG. 11(*a*).

In ejecting a medium droplet, the driving pulses P4, P6, and P7 are selected to generate ejection pulse for a medium droplet (medium-droplet ejection pulse) illustrated in FIG. 11(*b*).

In ejecting a small droplet, the driving pulse P2 is selected to generate an ejection pulse for a small droplet (small-droplet ejection pulse) illustrated in FIG. 11(*c*).

In applying a first non-ejection pulse (micro-vibration pulse), the driving pulse P1 is selected to generate the first non-ejection pulse (micro-vibration pulse) illustrated in FIG. 11(*d*). That is, the driving pulse P1 included in the common driving waveform Vcom is converted into the first non-ejection pulse.

The large-droplet ejection pulse is used to perform the first dummy ejection operation (line flushing operation). The small-droplet ejection pulse is used to perform the second dummy ejection operation (star flushing operation). The ejection pulse for dummy ejection can also be used as a printing ejection pulse, thus allowing efficient ejection of liquid droplets.

Moreover, in the image-forming area, the first non-ejection pulse P1 is applied to a pressure generator corresponding to at least one nozzle that does not eject a droplet. Micro-vibration, which vibrates a meniscus of ink in the nozzle without ejecting a droplet, is performed by the first non-ejection pulse P1, and the increase in viscosity of the ink in the nozzle is controlled.

On the other hand, in the non-image-forming area, the second non-ejection pulse Pb, which vibrates the meniscus of ink more greatly than the first non-ejection pulse P1, is applied to a pressure generator, and mist adhering near the nozzle is drawn into the inside of the nozzle.

Next, other examples of the driving waveform used in the first dummy ejection operation are described with reference to FIG. 12.

Figure 12:
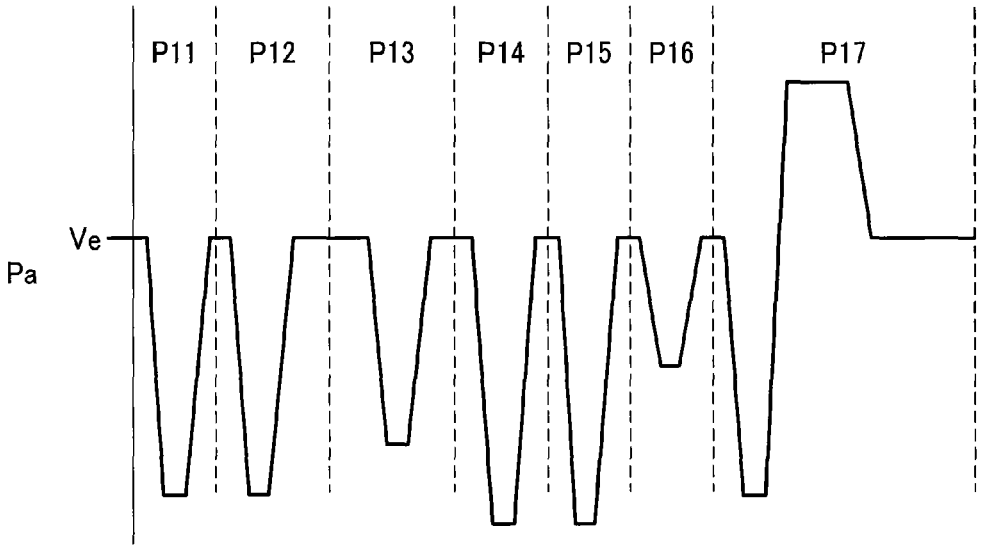
FIG. 12 is a diagram of a driving waveform used for a first dummy ejection operation according to one embodiment of the present disclosure.

A dummy ejection driving waveform Pa illustrated in FIG. 12 is a driving waveform that is used for a line flushing operation and includes driving pulses P11 to P17. This dummy ejection driving waveform Pa can eject the dummy ejection droplet, which has a faster droplet ejection speed (droplet speed) than a large droplet, by selecting all the driving pulses P1 to P6 in the above-mentioned common driving waveform Vcom.

In this way, by making the droplet speed of the dummy ejection droplet larger (or faster) than the large droplet speed, even if the viscosity of ink in a nozzle having little frequency of use increases, it becomes possible to carry out the dummy ejection operation.

Figure 13:
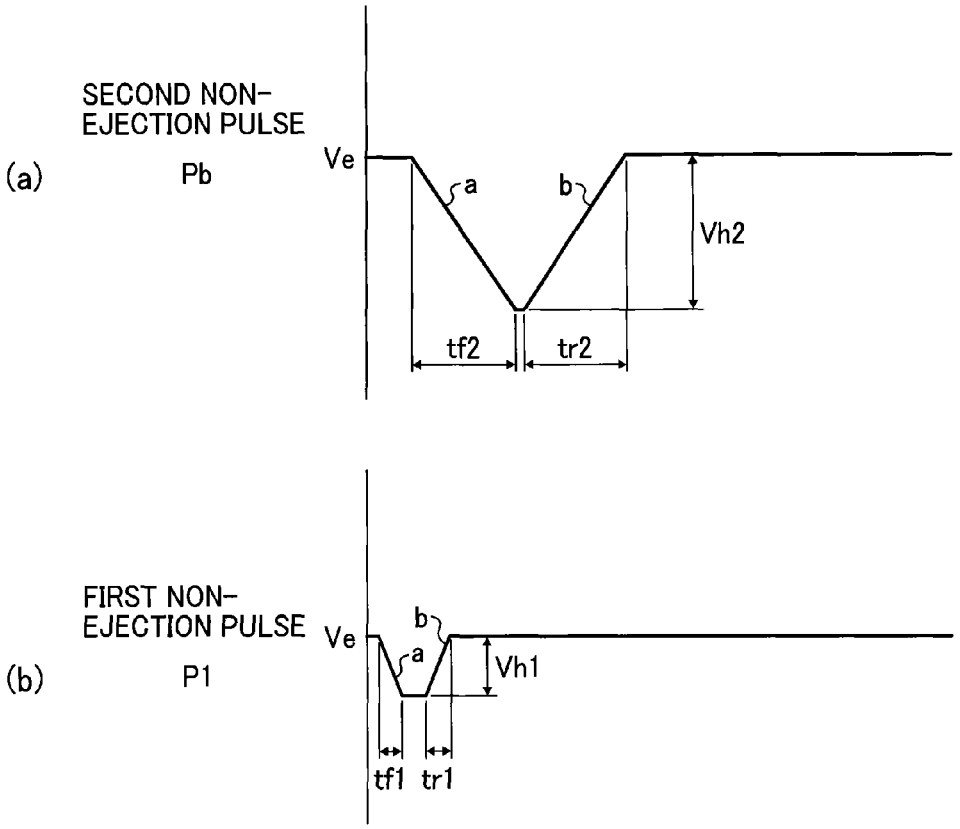
FIG. 13 is a chart of a second non-ejection pulse which vibrates meniscus in a non-image-forming area as compared with a first non-ejection pulse according to one embodiment of the present disclosure.

Next, the second non-ejection pulse, which vibrates a meniscus of ink in a nozzle at the non-image-forming area is described with reference to FIG. 13. The second non-ejection pulse is illustrated in FIG. 13(*a*), and the first non-ejection pulse is illustrated in FIG. 13(*b*).

As compared with the first non-ejection pulse P1, the second non-ejection pulse Pb has both a long falling time tf2 of a falling waveform element a, and long rising time tr2 of a rising waveform element b (tf2>tf1, tr2>tr1), and has a large peak value Vh2 (Vh2>Vh1). Thus, without ejecting a droplet, the second non-ejection pulse Pb can make the amplitude of vibration of the meniscus larger than the first non-ejection pulse P1.

Figure 14:
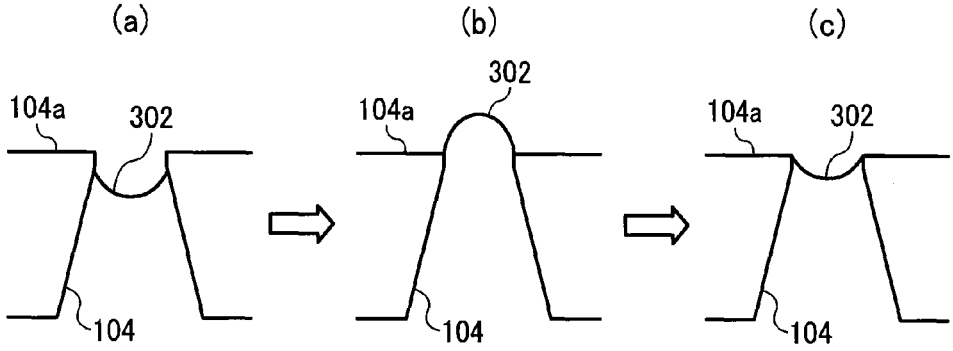
FIG. 14 is a schematic view of a state of a nozzle part by applying a second non-ejection pulse according to one embodiment of the present disclosure.
Figure 15:
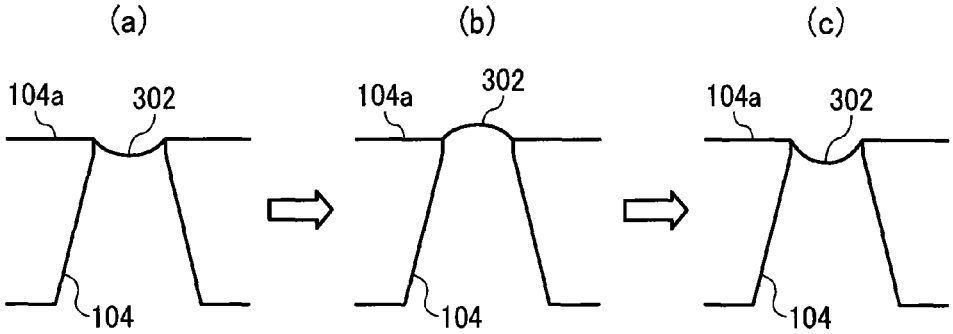
FIG. 15 is a schematic view of a state of a nozzle part by applying a first non-ejection pulse according to one embodiment of the present disclosure.

Concretely, when the first non-ejection pulse P1 is applied, as shown in FIG. 15, the meniscus 302 of ink in the nozzle vibrates to such an extent that it rises slightly from the nozzle surface 104*a*. On the other hand, when the second non-ejection pulse Pb is applied, as shown in FIG. 14, the meniscus 302 of ink in the nozzle vibrates so that it can rise more greatly from the nozzle surface 104*a* than when applying the first non-ejection pulse P1.

Here, in FIG. 14 and FIG. 15, each figure (a) shows the state where the falling waveform element a of the non-ejection pulse is applied, and the meniscus 302 of ink is drawn into the inside of the nozzle 104 most deeply. Each figure (b) shows the state where the rising waveform element b of the non-ejection pulse is applied and the meniscus 302 of ink rises from the nozzle surface the most. Each figure (c) shows the state when the meniscus 302 returns to the initial state by the end of the non-ejection pulse.

Next, the case where ink mist adhered near the nozzle by ejecting the ink consecutively for a long time is described with reference to FIG. 16.

Figure 16:
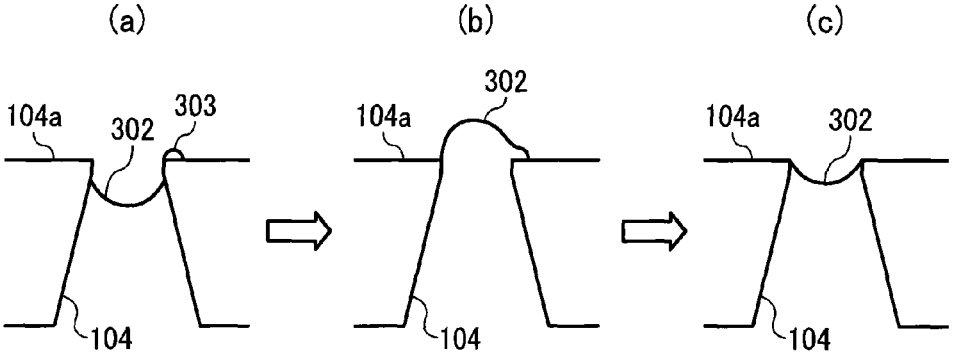
FIG. 16 is a schematic view of a state of a nozzle part with adhered ink mist by applying a second non-ejection pulse according to one embodiment of the present disclosure.

Here, FIG. 16(*a*) shows the state where the falling waveform element a of the second non-ejection pulse Pb is applied, and the meniscus 302 of ink is drawn into the inside of the nozzle 104 most deeply. FIG. 16(*b*) shows the state where the rising waveform element b of the second non-ejection pulse Pb is applied, and the meniscus 302 of ink rises from the nozzle surface the most. FIG. 16(*c*) shows the state when the meniscus 302 returns to an initial state by the end of the second non-ejection pulse Pb.

Since the second non-ejection pulse Pb vibrates the meniscus of ink greatly, as shown in FIG. 16(*b*), the meniscus 302 of ink catches the ink mist 303 shown in FIG. 16(*a*) adhering near the nozzle when it rises out of the nozzle. Then, as shown in FIG. 16(*c*), when the meniscus of ink returns to the initial state, the ink mist 303 is drawn into the inside of the nozzle 104 and is removed from the circumference of the nozzle 104.

Thus, the ink mist adhered near the nozzle by ejecting the ink consecutively for a long time is removed.

Here, as mentioned above, because the falling time tf and rising time tr are lengthened, the droplet can be kept from being ejected, even if a large meniscus vibration can be obtained. Therefore, if the second non-ejection pulse Pb is put in the common driving waveform Vcom used for printing, the length of the common drive waveform Vcom becomes long, and it causes a lowering of the driving frequency (a decreasing of the print speed).

Therefore, in the present embodiment, the driving waveform generator 701 generates and outputs the second non-ejection pulse Pb independently, which is different from a common driving waveform Vcom.

Thus, the second non-ejection pulse Pb, which vibrates the meniscus of ink greatly, can be applied without lengthening a driving cycle time of the driving waveform at the time of printing.

Moreover, the second non-ejection pulse can draw the ink mist into the inside of the nozzle more certainly by using the overflow driving signal, which draws the meniscus of ink into the inside of the nozzle after flooding out of the nozzle edge with the meniscus of ink.

Next, an example of the method of applying the second non-ejection pulse with the first dummy ejection operation is described with reference to FIG. 17.

The second non-ejection pulse Pb is applied when the recording head 51 faces an area of a continuous recording medium where an image is not formed.

That is, when performing the first dummy ejection operation (e.g., the line flashing operation), the area where the flashing line is recorded cannot be used, and is cut out after printing. Therefore, this area that cannot be used is used as the area where an image is not formed (i.e., a non-image-forming area).

Figure 17:
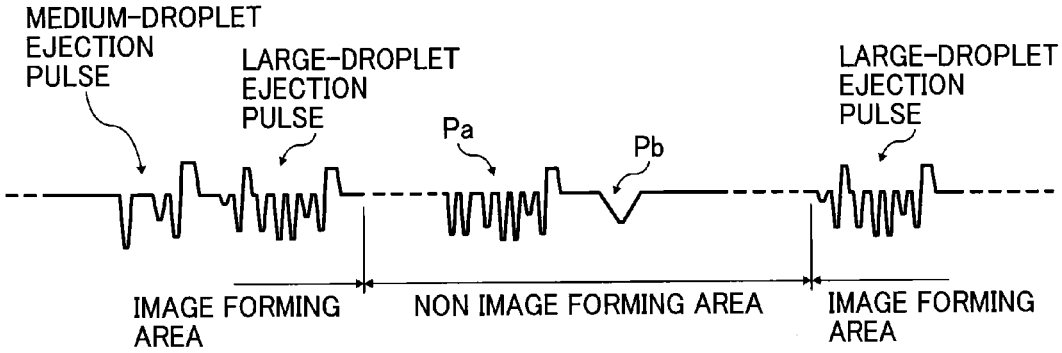
FIG. 17 is a diagram of a driving waveform including a first dummy ejection operation and a second non-ejection pulse according to one embodiment of the present disclosure.

For example, as shown in FIG. 17, after applying the dummy ejection driving waveform Pa (i.e., after the first dummy ejection operation was performed) in the non-image-forming area, the second non-ejection pulse Pb is applied.

Thus, even if the ink mist exists near the nozzle and cannot be removed in the usual first dummy ejection operation, the ink mist can be drawn into the inside of a nozzle by the second non-ejection pulse Pb.

In addition, in the case that long-time continuation printing is performed and the printed medium has many portions to which a droplet is not ejected from a nozzle (called white paper portions), the increase in viscosity of ink becomes large. Thus, it may be difficult to remove sufficiently the ink with increased viscosity by using only the first dummy ejection operation. Furthermore, during the long-time continuation printing, a lot of ink mist may adhere near the nozzle.

At this time, because the second non-ejecting pulse Pb is applied immediately after the first dummy ejection operation, the ink which has increased viscosity and was not able to be removed and the ink mist which adheres near the nozzle can be drawn into the inside of the nozzle, and a normal shape of meniscus of ink can be formed. Moreover, because the ink mist that adheres near the nozzle is removed immediately, the ink mist is prevented from enlarging and falling during the printing operation.

Figure 18:
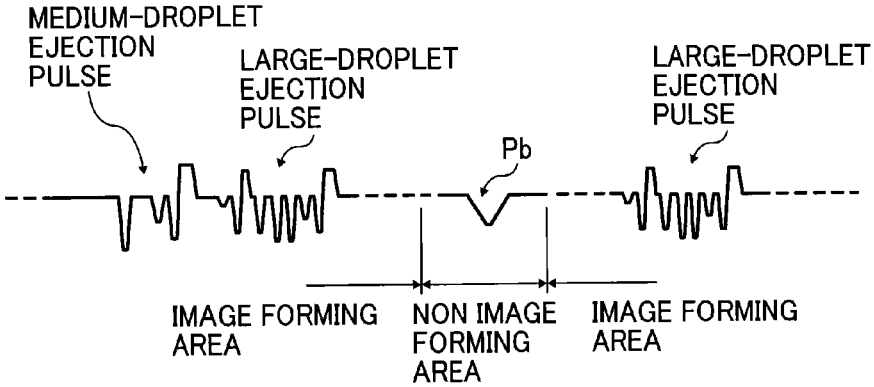
FIG. 18 is a diagram of a driving waveform including a second dummy ejection operation and a second non-ejection pulse according to one embodiment of the present disclosure.

Next, an example of a method of applying the second non-ejection pulse with the second dummy ejection operation is described with reference to FIG. 18.

When performing the second dummy ejection operation, the blank space in a page, instead of an area that cannot be used, as mentioned above, is used as the non-image-forming area. The second non-ejection pulse Pb is applied when the recording head 51 faces the blank space in a page.

Thus, even if the ink mist exists near the nozzle and cannot be removed in the usual second dummy ejection operation, the second non-ejecting pulse Pb is applied and the ink mist that adheres near the nozzle can be drawn into the inside of the nozzle, and normal shape of the meniscus of ink can be formed. Moreover, because the ink mist that adheres near the nozzle is removed immediately, the ink mist is prevented from enlarging and falling during the printing operation.

Figure 19:
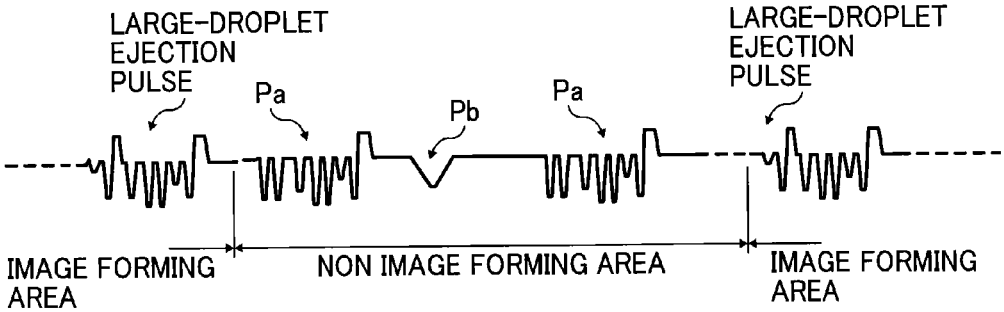
FIG. 19 is a diagram of a driving waveform including a first dummy ejection operation and a second non-ejection pulse according to another embodiment of the present disclosure.

Next, another example of the method of applying the second non-ejection pulse with the first dummy ejection operation is described with reference to FIG. 19.

Here, in the non-image-forming area, the second non-ejecting pulse Pb is applied immediately after the first dummy ejection operation. Furthermore, the first dummy ejection operation is performed again immediately after the second non-ejecting pulse Pb.

That is, because the second non-ejecting pulse Pb is applied immediately after the first dummy ejection operation, the ink with increased viscosity that was not able to be removed and the ink mist that adheres near the nozzle can be drawn into the inside of the nozzle, and the normal shape of the meniscus of ink can be formed. Furthermore, because the first dummy ejection operation is performed again immediately after the second non-ejecting pulse Pb, the normal shape of the meniscus of ink can be formed more certainly.

Thus, even if a lot of ink mist exists near the nozzle and cannot be removed in the usual first dummy ejection operation, the meniscus of ink can be returned to a stable state because the ink mist is drawn into the inside of the nozzle by the second non-ejection pulse Pb and is ejected with the ink by the first dummy ejection operation again.

In the present specification, the term "ink" is not limited just to so-called "ink", and is used to collectively refer to various types of liquids with which the image formation is performed, such as recording liquid, fixing liquid, and toner.

According to one aspect of the present disclosure, the number of nozzle or emissions which occur in long-time continuation ejection can be reduced without lowering printing speed. An image forming apparatus according to one embodiment includes a recording head including a plurality of nozzles to eject liquid droplets, a plurality of individual liquid chambers communicated with the plurality of nozzles, and a plurality of pressure generators to generate pressure to pressurize liquid in the plurality of individual liquid chambers; a head driving control circuit to apply an ejection pulse to a pressure generator of the plurality of pressure generators corresponding to an ejection nozzle of the plurality of nozzles; and a dummy ejection control circuit to control dummy ejection operation to eject liquid droplets not contributing to image formation. The dummy ejection control circuit is configured to control, as a dummy ejection operation, a first dummy ejection operation to eject the liquid droplets to a non-image-forming area per a constant length of a continuous recording medium and a second dummy ejection operation to eject the liquid droplets to an image-forming area of the continuous recording medium. The head driving control circuit applies a first non-ejection pulse to pressure generators corresponding to at least one of non-ejection nozzles to vibrate the meniscus of liquid in the non-ejection nozzles without ejecting liquid droplets in the image-forming area, and applies a second non-ejection pulse, which vibrates the meniscus of liquid more greatly than the first non-ejection pulse, to pressure generators corresponding to at least one of non-ejection nozzles to vibrate the meniscus of liquid in the non-ejection nozzles without ejecting liquid droplets in the non-image-forming area.

According to another aspect of the present disclosure, ink mist near a nozzle can be drawn into the nozzle with certainty. That is, the second non-ejection pulse is a pulse to let the meniscus of liquid overflow to an outside of a nozzle edge.

According to yet another aspect of the present disclosure, a dummy ejection operation can be performed efficiently. That is, the ejection pulse applied in at least one of the first dummy ejection operation and the second dummy ejection operation is the same as an ejection pulse applied in image formation.

According to yet another aspect of the present disclosure, a dummy ejection operation can be performed still more efficiently. That is, the recording head is configured to eject different sizes of liquid droplets. The liquid droplets ejected in the first dummy ejection operation are the largest of the different sizes of liquid droplets, and the liquid droplets ejected in the second dummy ejection operation are the smallest of the different sizes of liquid droplets.

According to yet another aspect of the present disclosure, even if the viscosity of ink in a nozzle increases, the dummy ejection operation can be carried out with certainty. That is, a droplet speed of the dummy ejection droplet in the first dummy ejection operation is larger than a droplet speed of the ejection droplet is used in image formation.

According to yet another aspect of the present disclosure, the meniscus of ink can be returned to a stable state with certainty. That is, the first dummy ejection operation, an operation of applying the second non-ejection pulse, and the first dummy ejection operation are performed sequentially in a non-image forming area.

Each of the functions of the described embodiments may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

The above-described embodiments and effects thereof are illustrative only and do not limit the present disclosure. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, the disclosure of the present inventions may be practiced otherwise than as specifically described herein.

The invention claimed is:

1. An image forming apparatus, comprising:

a recording head including a plurality of nozzles to eject liquid droplets, a plurality of individual liquid chambers communicating with the plurality of nozzles, and a plurality of pressure generators to generate pressure to pressurize liquid in the plurality of individual liquid chambers;

a head driving control circuit to apply an ejection pulse to a pressure generator of the plurality of pressure generators corresponding to an ejection nozzle of the plurality of nozzles; and a dummy ejection control circuit to control a dummy ejection operation to eject liquid droplets not contributing to image formation, wherein the dummy ejection control circuit controls a first dummy ejection operation to eject the liquid droplets to a non-image-forming area per a constant length of a continuous recording medium and a second dummy ejection operation to eject the liquid droplets to an image forming area of the continuous recording medium, wherein the head driving control circuit applies a first non-ejection pulse to pressure generators corresponding to at least one of non-ejection nozzles to vibrate a meniscus of liquid in the non-ejection nozzles without ejecting the liquid droplets in the image forming area of the continuous recording medium, and applies a second non-ejection pulse, which vibrates the meniscus of liquid greater than the first non-ejection pulse, to pressure generators corresponding to the at least one of non-ejection nozzles to vibrate the meniscus of liquid in the non-ejection nozzles without ejecting liquid droplets in the non-image forming area of the continuous recording medium; and the head driving control circuit applies the second non-ejection pulse after the first dummy ejection operation when the recording head faces the non-image forming area of the continuous recording medium.

2. The image forming apparatus of claim 1, wherein the head driving control circuit applies the second non-ejection pulse, which is a pulse to cause the meniscus of liquid to overflow to an outside of a nozzle edge.

3. The image forming apparatus of claim 1, wherein the head driving control circuit applies the ejection pulse, which is applied in at least one of the first dummy ejection operation and the second dummy ejection operation and is the same as an ejection pulse applied in the image formation.

4. The image forming apparatus of claim 1, wherein the recording head is configured to eject different sizes of liquid droplets, and the liquid droplets ejected in the first dummy ejection operation are a largest of the different sizes of liquid droplets, and the liquid droplets ejected in the second dummy ejection operation are a smallest of the different sizes of liquid droplets.

5. The image forming apparatus of claim 1, wherein the dummy ejection control circuit is configured to control the dummy ejection operation, and a droplet speed of the dummy ejection droplet in the first dummy ejection operation is larger than a droplet speed of the ejection droplet used in the image formation.

6. The image forming apparatus of claim 1, wherein the dummy ejection control circuit is configured to control the dummy ejection operation and, in the first dummy ejection operation, an operation of applying the second non-ejection pulse and the first dummy ejection operation are performed sequentially in the non-image forming area of the continuous recording medium.

7. An image forming apparatus, comprising:

a recording head including a plurality of nozzles to eject liquid droplets, a plurality of individual liquid chambers communicating with the plurality of nozzles, and a plurality of pressure generators to generate pressure to pressurize liquid in the plurality of individual liquid chambers;

means for applying an ejection pulse to a pressure generator of the plurality of pressure generators corresponding to an ejection nozzle of the plurality of nozzles; and means for controlling a dummy ejection operation to eject liquid droplets not contributing to image formation, wherein the means for controlling controls a first dummy ejection operation to eject the liquid droplets to a non-image-forming area per a constant length of a continuous recording medium and a second dummy ejection operation to eject the liquid droplets to an image forming area of the continuous recording medium, wherein the means for applying applies a first non-ejection pulse to pressure generators corresponding to at least one of non-ejection nozzles to vibrate a meniscus of liquid in the non-ejection nozzles without ejecting the liquid droplets in the image forming area of the continuous recording medium, and applies a second non-ejection pulse, which vibrates the meniscus of liquid greater than the first non-ejection pulse, to pressure generators corresponding to the at least one of non-ejection nozzles to vibrate the meniscus of liquid in the non-ejection nozzles without ejecting liquid droplets in the non-image forming area of the continuous recording medium; and the means for applying applies the second non-ejection pulse after the first dummy ejection operation when the recording head faces the non-image forming area of the continuous recording medium.

8. An image forming method for an image forming apparatus having a recording head including a plurality of nozzles to eject liquid droplets, a plurality of individual liquid chambers communicating with the plurality of nozzles, and a plurality of pressure generators to generate pressure to pressurize liquid in the plurality of individual liquid chambers, the method comprising:

controlling a dummy ejection operation to eject liquid droplets not contributing to image formation, including a first dummy ejection operation to eject the liquid droplets to a non-image-forming area per a constant length of a continuous recording medium and a second dummy ejection operation to eject the liquid droplets to an image forming area of the continuous recording medium;

applying a first non-ejection pulse to pressure generators corresponding to at least one of non-ejection nozzles to vibrate a meniscus of liquid in the non-ejection nozzles without ejecting the liquid droplets in the image forming area of the continuous recording medium; and applying a second non-ejection pulse, which vibrates the meniscus of liquid greater than the first non-ejection pulse, to pressure generators corresponding to the at least one of non-ejection nozzles to vibrate the meniscus of liquid in the non-ejection nozzles without ejecting liquid droplets in the non-image forming area of the continuous recording medium, wherein the step of applying the second non-ejection pulse includes applying the second non-ejection pulse after the first dummy ejection operation when the recording head faces the non-image forming area of the continuous recording medium.

9. The image forming method of claim 8, further comprising;

applying the second non-ejection pulse and the first dummy ejection operation sequentially in the non-image forming area of the continuous recording medium.

10. The image forming apparatus of claim 8, further comprising:

applying an ejection pulse to a pressure generator of the plurality of pressure generators corresponding to an ejection nozzle of the plurality of nozzles, wherein the ejection pulse is applied in at least one of the first dummy ejection operation and the second ejection operation and is the same as an ejection pulse applied in the image formation.

* * * * *